US006779516B1

(12) United States Patent
Shureb

(10) Patent No.: US 6,779,516 B1
(45) Date of Patent: Aug. 24, 2004

(54) CLOSED CRANKCASE VENTILATION SYSTEM WITH FLOW METER FOR MONITORING ENGINE OPERATION

(75) Inventor: Robert F. Shureb, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/448,906

(22) Filed: May 30, 2003

(51) Int. Cl.[7] ..... F01M 13/00
(52) U.S. Cl. ..... 123/572
(58) Field of Search ..... 123/572–574

(56) References Cited

U.S. PATENT DOCUMENTS 3,589,347 A * 6/1971 Sawada ..... 123/574
3,645,242 A * 2/1972 Horiuchi ..... 123/574
3,678,910 A * 7/1972 Marlett ..... 123/574
3,745,984 A 7/1973 King
3,818,942 A 6/1974 King
3,951,115 A * 4/1976 Brisko ..... 123/406.69
4,760,833 A * 8/1988 Tatyrek ..... 123/574
4,856,487 A * 8/1989 Furuya ..... 123/574
5,003,943 A 4/1991 Lafferty, Sr.
5,669,366 A 9/1997 Beach et al.
5,722,376 A * 3/1998 Sweeten ..... 123/574
5,753,805 A 5/1998 Maloney
5,897,597 A 4/1999 O'Daniel
6,123,061 A 9/2000 Baker et al.
6,240,772 B1 6/2001 Thomas
6,247,463 B1 6/2001 Fedorowicz et al.
6,418,917 B1 7/2002 Bistue
6,435,170 B1 * 8/2002 Hamelink et al. ..... 123/572
6,460,525 B1 10/2002 Shureb
6,478,019 B2 11/2002 Fedorowicz
6,546,921 B1 * 4/2003 Callahan ..... 123/573
2002/0069860 A1 6/2002 Marcil
2002/0078936 A1 6/2002 Shureb

* cited by examiner

*Primary Examiner*—Marguerite McMahon
(74) *Attorney, Agent, or Firm*—Brooks Kushman P.C.

(57) ABSTRACT

A closed crankcase ventilation system for a recirculating effluent gas stream of an internal combustion engine is provided with an air flow meter. The flow meter provides a signal to an engine controller continuously during normal engine operation that is proportional to the flow of gas through the system. The signal is used to trigger a control system output that may activate an alarm, shutdown the engine, or indicate a need for engine service.

19 Claims, 1 Drawing Sheet

CLOSED CRANKCASE VENTILATION SYSTEM WITH FLOW METER FOR MONITORING ENGINE OPERATION

BACKGROUND OF THE INVENTION

1. Field of the Invention

This invention relates to closed crankcase ventilation systems for internal combustion engines.

2. Background Art

The crankcase of an operating internal combustion engine is pressurized by blow-by gases (gases that flow past the piston rings, valve stems and turbo seals), and in the case of a two-cycle engine, by leakage from the air box. Venting is required to control crankcase pressure and thereby minimize oil leakage past crankshaft seals, oil pan gaskets, etc., and to prevent harmful liquids, including sulfuric acid, from condensing in the engine. The large quantity of lube oil contained in the crankcase, which may be extremely agitated under normal engine operating conditions, complicates the ventilation task. High temperature and agitation cause oil mist (vapor and droplets) to become entrained in the crankcase gases or effluent. This oil mist must be separated from the effluent prior to its discharge from the crankcase, to prevent loss of useful engine oil and environmental pollution. An effective crankcase ventilation system is one that controls crankcase pressure, and minimizes loss and contamination of the lube oil.

There are two types of crankcase ventilation systems commonly used in internal combustion engines. An "open" crankcase ventilation system discharges crankcase effluent gases to the atmosphere, while a "closed" crankcase ventilation system avoids atmospheric discharge by piping the gases to the engine's air inlet system, (typically upstream of the turbocharger compressor in a diesel engine).

The function of an open system is to vent effluent gases to the atmosphere, free from oil droplets. It must maintain minimal positive crankcase pressure throughout the normal wear life of the engine, while operating under all speeds, loads and operating attitudes for which the engine was designed. A closed system has the additional function of limiting vacuum in the crankcase through use of a valve or by allowing filtered fresh air into the engine. Diesel engines typically use a Crankcase Depression Regulator (diaphragm valve). Gasoline engines, which have lower blow-by flow rates than diesels, typically use PCV's (Positive Crankcase Ventilation Valves).

The closed crankcase ventilation system has the added requirement of minimizing the inherent risk of carrying excessive oil (pull-over) into the air intake system. Any oil delivery to the air intake is considered undesirable oil consumption and increased exhaust emissions. Extreme oil pull-over can cause loss of engine control or over-speed if the oil is burned, or flooding of cylinders and hydrostatic lock, with associated damage (e.g., bent connecting rod or blown cylinder head gasket). Crankcase ventilation system design must ensure that the system (either open or closed) will function properly for the life of the engine, under all possible operating conditions, including operation at extreme tilt angles, increasing blow-by levels due to engine wear, air inlet restrictions, engine speeds, etc.

The quantity of effluent gas flowing through a crankcase ventilation system naturally increases over time as pistons, piston rings, cylinder lines, and other engine components wear. Failure of a cylinder component (e.g., scuffing, broken or burned ring, piston, etc.) can cause a drastic increase in effluent volume. Furthermore, a failure of a single cylinder may, if the engine is continued to operate, cause catastrophic engine failure due to secondary damage (e.g., connecting rod through the wall of the crankcase), or in the case of an engine with a closed crankcase ventilation system due to oil pull-over. With an open crankcase ventilation system, this flow increase results in increased crankcase pressure. Crankcase pressure monitors have been used successfully on engines with open crankcase ventilation systems to detect a cylinder failure, allowing the engine to be shutdown before major secondary damage occurs. On engines with a closed crankcase ventilation system, the system itself limits pressure increase thereby making crankcase pressure monitors ineffective. Another limitation of crankcase pressure monitors is that they are set for a single pressure, which if exceeded triggers a response; no information about the engine is given at various operating pressures below the preset limit.

Blow-by measurement is a commonly used diagnostic technique during engine development or for evaluating the condition of an engine in service. The usual method employed is to attach a gas flow meter to the engine ventilation system. High readings can indicate a worn out engine, loss of ring sealing, impending cylinder kit failure, or sealing problems in other engine systems (e.g., turbocharger).

Ever more stringent emission requirements have led to more effective oil separation in closed crankcase ventilation systems. Some systems already incorporate filters that need to be periodically replaced for proper operation. Engine oil consumed through recirculated effluent may someday have to be controlled through the life of an engine to ensure compliance with emission standards.

There is a need for a simple and cost effective system for continuous monitoring of engine blow-by gas flow, for use as a tool to evaluate the condition of an engine, and to diagnose problems associated with increased blow-by. There is a need to warn the engine operator of crankcase ventilation system malfunction or need to change filters (for fresh air or oil separation) in a closed crankcase ventilation system during normal engine operation. There is a need for detecting cylinder kit damage, particularly in closed crankcase ventilation systems, and of warning the operator or reducing engine power to avoid subsequent catastrophic engine failure. There may be a need in the future to monitor the amount of oil consumed through a closed crankcase ventilation system, or a need to detect an increased level of oil concentration in the effluent gas stream. The present invention is directed to providing such a system that addresses the above problems as summarized below.

SUMMARY OF THE INVENTION

According to one aspect of the invention, an internal combustion engine is provided with a closed crankcase ventilation system including a flow meter. The engine comprises at least one combustion chamber and a reciprocating piston. The combustion chamber has an exhaust port and an air intake on a first side of the piston and crankcase on a second side of the piston. The closed crankcase ventilation system recirculates a effluent gas stream from the crankcase to the air intake. At least one flow meter is disposed in the effluent gas stream to measure the volume of gas flowing through the ventilation system. A signal is produced by the flow meter that senses the volume of gas flow. The engine control system receives the signal indicative of the volume of gas flow and monitors the signal to provide a control system output based upon the sensed volume of gas flow. The control system output can then be sent to an engine operation log that electronically records the volume of gas flow as an engine diagnostic parameter. This blow-by history can indicate the amount of wear through the life of the engine. The control system output can be used to warn the operator of a sudden increase in blow-by, indicating that the engine is in need of service (e.g., to replace ventilation system filters or to correct other engine component malfunctions). The control system output can be used to reduce engine power or shut the engine down to prevent subsequent major damage that could occur following relatively minor damage to a cylinder, piston, piston ring or other engine component.

According to another aspect of the present invention a closed crankcase ventilation system is provided for an ignition engine having a crankcase, an air inlet, and an engine control. The internal combustion engine may be a compression ignition or spark ignition engine that may be turbocharged or naturally aspirated. The ventilation system is ported from the crankcase to the air intake system of the engine. A set of hoses direct an effluent gas stream from the crankcase to the air intake system. At least one flow meter is connected in fluid flow communication with the hoses to measure the air flow volume passing through the hoses. The measured effluent flow may be routed to the upstream side of a turbocharger compressor of a turbocharged engine or to the intake manifold of a naturally aspirated engine. The flow meter produces a signal indicative of air flow volume. The signal is provided to the engine control that monitors the signal to determine if the engine should be shut down or serviced.

According to other aspects of the invention the crankcase may be ported through a breather that may comprise one or more rocker cover breathers. Alternatively, the breather may comprise a flywheel housing breather, oil pan breather, cylinder block breather or gear case breather.

The flow meter may be an electronic air flow meter. More specifically, the flow meter may be a simple turbine type flow meter with a magnetic pick-up. Alternatively, the flow meter may be a mass flow sensor that is capable of detecting an increase in oil concentration in the effluent gas stream. In another alternative embodiment, the flow meter could be used in conjunction with a continuous pressure output sensor (crankcase pressure transducer). The flow meter and crankcase pressure transducer may offer a more cost effective system that would be capable of detecting an increase in oil concentration in the effluent gas stream.

These and other aspects of the present invention will be better understood in view of the attached drawings and following detailed description of a preferred embodiment of the invention.

DETAILED DESCRIPTION OF THE PREFERRED EMBODIMENT(S)

Figure 1:
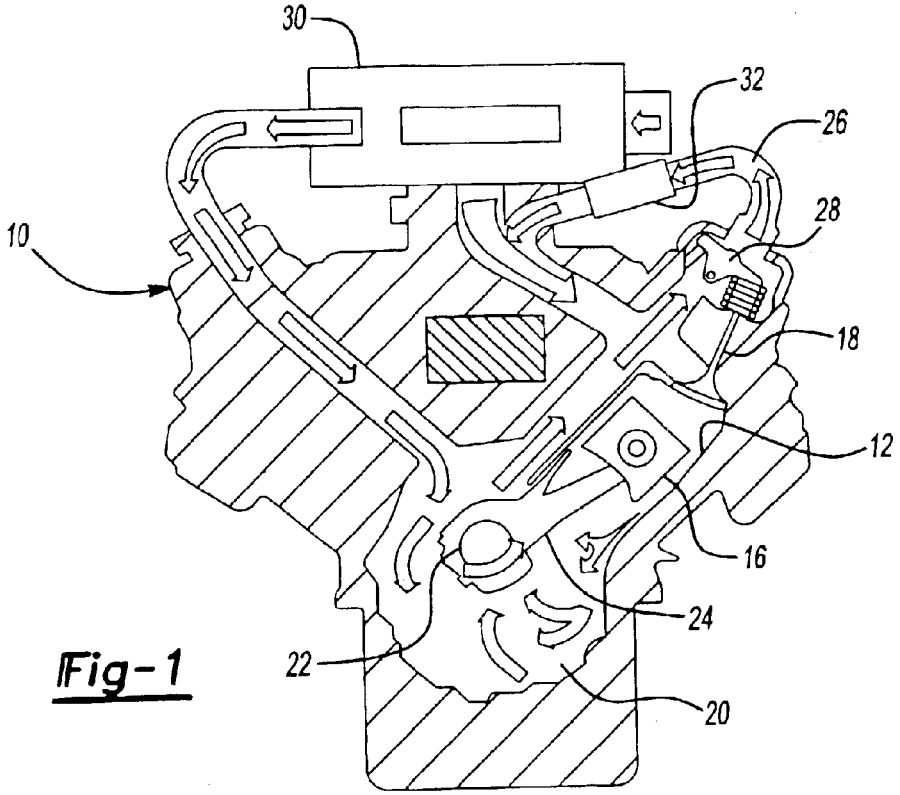
FIG. 1 is a schematic view of an internal combustion engine having a closed crankcase ventilation system and a flow meter.

Referring now to FIG. 1, an internal combustion engine 10 is shown in schematic form to illustrate the flow of crankcase blow-by gases in a closed crankcase ventilation system made according to the present invention. The internal combustion engine 10 has at least one combustion chamber 12. A piston 16 is received in each of the combustion chambers 12 for reciprocation as a result of the internal combustion process. The combustion chamber 12 has an intake valve 18 through which air is drawn as part of the combustion process.

The engine 10 has a crankcase 20 in which the crankshaft 22 is disposed. The crankshaft 22 is connected to each of the pistons 16 by a connecting rod 24. During the combustion process, a portion of the products of combustion may be drawn into the crankcase 20 around the piston 16 that are known as crankcase blow-by gases.

A closed crankcase ventilation system 26 routes a effluent gas stream 28 to the engine air intake 30. A flow meter 32 is provided in the closed crankcase ventilation system 26 to measure the volume of gas flow constituted in the effluent gas stream 28.

Figure 2:
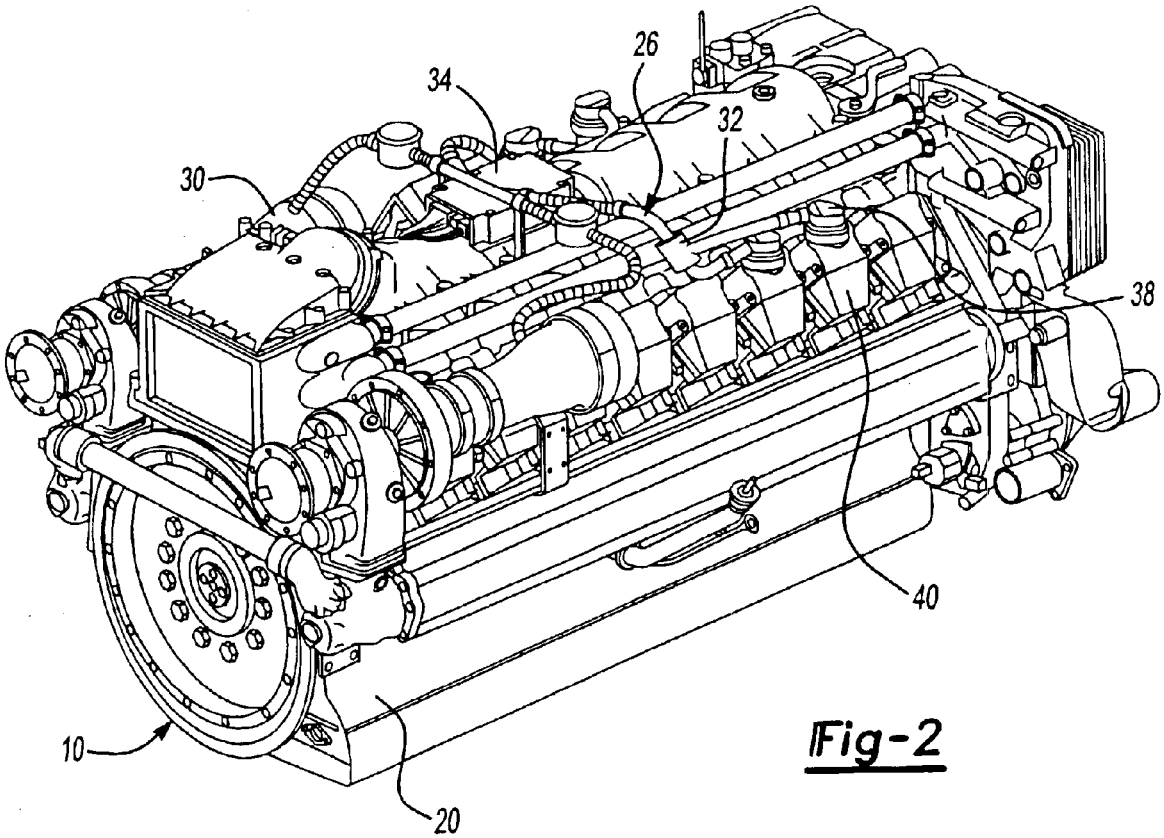
FIG. 2 is a perspective view of a compression ignition internal combustion engine.

Referring now to FIG. 2, an internal combustion engine 10 is shown that includes a crankcase 20 that is ventilated by means of the closed crankcase ventilation system 26. The closed crankcase ventilation system 26 directs the effluent gas stream 28 to the engine air intake 30. The flow meter 32 provides an electronic engine input to the engine control module 34 of the engine 10. The flow meter 32 is connected by means of hoses 36 to a crankcase breather 38 that is mounted on a rocker cover 40. The crankcase breather 38 that is illustrated in FIG. 2, is a rocker cover breather, however, it should be understood that other types of breathers may be used in accordance with the present invention such as a flywheel housing breather, an oil pan breather, a cylinder block breather, or a gear case breather. The type of breather is determined by engine design considerations and the specific types of breathers are equivalent in function and in the way that they accomplish the same desired result.

In operation, engine blow-by gases are directed as a effluent gas stream 28 from the crankcase 20 through the closed crankcase ventilation system 26 to the engine air intake 30. The flow meter 32 is preferably an electronic air flow meter. The electronic air flow meter may be a simple turbine air flow meter or may be a mass flow sensor. The use of a mass flow sensor would permit the system to detect an increase in oil concentration in the effluent gas stream. The flow meter may also be used in conjunction with a crankcase pressure transducer to detect an increase in the effluent gas stream.

The control system, or ECM 34, receives electrical signals indicative of the volume of gas flow from the flow meter. The control system monitors the signal to provide at least one control system output that is dependent upon the sensed quantity of gas flow.

The control system 34 determines if the volume of gas flow exceeds a predetermined level. If so, the control system produces a control system output. The control system output may be used by the engine to shut down the engine or cause the engine to operate at a reduced power level. Alternatively, the control system output can be used to activate an alarm that may be used to warn an operator of an engine problem or an impending engine problem. The control system output may also be recorded in an engine operation log that electronically records the volume of gas flowing through the crankcase ventilation system as an engine diagnostic parameter.

The engine diagnostic parameter may be used to determine whether an engine should be overhauled and may also be used in determining whether a crankcase pressure switch should be replaced.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An internal combustion engine, comprising:

at least one combustion chamber and a reciprocating piston, the combustion chamber having an exhaust and an air intake on a first side of the piston and a crankcase on a second side of the piston;

a closed crankcase ventilation system for recirculating an effluent gas stream from the crankcase to the air intake, the closed crankcase ventilation system further comprising at least one flow meter disposed in the effluent gas stream that measures the volume of gas flowing through at least a part of the ventilation system continuously whenever the engine is operated and produces a signal indicative of the volume of gas flow; and a control system that receives the signal indicative of the volume of gas flow and monitors the signal to provide at least one control system output that is dependent upon the sensed quantity of gas flow, wherein the control system output is recorded in an engine operation log that records the volume of gas flow as an engine diagnostic parameter.

2. The internal combustion engine of claim 1 wherein the flow meter is an electronic air flow meter.

3. The internal combustion engine of claim 2 wherein the flow meter is a simple turbine type of flow meter.

4. The internal combustion engine of claim 1 wherein the flow meter is a mass flow sensor that also detects an increase in oil concentration in the effluent gas stream.

5. The internal combustion engine of claim 1 further comprising a breather ported to the crankcase.

6. The internal combustion engine of claim 5 wherein the breather further comprises a plurality of rocker cover breathers.

7. The internal combustion engine of claim 1 wherein the control system determines if the volume of gas flow exceeds a predetermined level and that produces the control system output when the gas flow exceeds the predetermined level.

8. The internal combustion engine of claim 7 wherein the control system output causes the engine to shut down or to operate at reduced power.

9. The internal combustion engine of claim 7 wherein the control system output activates an alarm perceptible to an operator to warn of an engine problem or an impending engine problem.

10. The internal combustion engine of claim 1 wherein the engine diagnostic parameter is used to determine whether a crankcase pressure switch should be replaced.

11. The internal combustion engine of claim 1 wherein the engine diagnostic parameter is used to determine whether the engine should be overhauled.

12. A closed crankcase ventilation system for an internal combustion engine having a crankcase, an air inlet, an air intake system, and an engine control, comprising:

a set of hoses ported to the crankcase of the engine and connecting to the air intake system that directs an effluent gas stream from the crankcase to the air intake system;

a flow meter connected in fluid flow communication with the hoses to continuously measure the air flow volume or mass passing through at least a part of the hoses during normal engine operation, wherein the flow meter produces a signal indicative of the air flow volume or mass that is provided to the engine control and the engine control monitors the signal and determines if an engine service output should be provided, wherein the flow meter is used in conjunction with a crankcase pressure transducer to detect an increase in oil concentration in the effluent gas stream.

13. The closed crankcase ventilation system of claim 12 further comprising a breather through which the hoses are ported to the crankcase.

14. The closed crankcase ventilation system of claim 13 wherein the breather further comprises a plurality of rocker cover breathers.

15. The closed crankcase ventilation system of claim 12 wherein the flow meter is an electronic air flow meter.

16. The closed crankcase ventilation system of claim 15 wherein the flow meter is a simple turbine type of flow meter.

17. The closed crankcase ventilation system of claim 12 wherein the flow meter is a mass flow sensor.

18. An internal combustion engine, comprising:

at least one combustion chamber and a reciprocating piston, the combustion chamber having an exhaust and an air intake on a first side of the piston and a crankcase on a second side of the piston;

a closed crankcase ventilation system for recirculating an effluent gas stream from the crankcase to the air intake, the closed crankcase ventilation system further comprising at least one flow meter disposed in the effluent gas stream that measures the volume of gas flowing through at least a part of the ventilation system continuously whenever the engine is operated and produces a signal indicative of the volume of gas flow; and a control system that receives the signal indicative of the volume of gas flow and monitors the signal to provide at least one control system output that is dependent upon the sensed quantity of gas flow exceeding a predetermined level, the control system output causing the engine to shut down or to operate at reduced power.

19. An internal combustion engine, comprising:

at least one combustion chamber and a reciprocating piston, the combustion chamber having an exhaust and an air intake on a first side of the piston and a crankcase on a second side of the piston;

a closed crankcase ventilation system for recirculating an effluent gas stream from the crankcase to the air intake, the closed crankcase ventilation system further comprising at least one flow meter disposed in the effluent gas stream that measures the volume of gas flowing through at least a part of the ventilation system continuously whenever the engine is operated and produces a signal indicative of the volume of gas flow; and a control system that receives the signal indicative of the volume of gas flow and monitors the signal to provide at least one control system output that is dependent upon the sensed quantity of gas flow exceeding a predetermined level, the control system output activating an alarm perceptible to an operator to warn of an engine problem or an impending engine problem.

* * * * *